US009262959B2

(12) United States Patent
Tsuge

(10) Patent No.: US 9,262,959 B2
(45) Date of Patent: Feb. 16, 2016

(54) EL DISPLAY DEVICE

(71) Applicant: Panasonic Corporation, Osaka (JP)

(72) Inventor: Hitoshi Tsuge, Osaka (JP)

(73) Assignee: JOLED INC, Tokyo (JP)

( * ) Notice: Subject to any disclaimer, the term of this patent is extended or adjusted under 35 U.S.C. 154(b) by 85 days.

(21) Appl. No.: 13/785,128

(22) Filed: Mar. 5, 2013

(65) Prior Publication Data

US 2013/0241966 A1 Sep. 19, 2013

(30) Foreign Application Priority Data

Mar. 13, 2012 (JP) ..... 2012-055548

(51) Int. Cl.

| | |
|---|---|
| ***G09G 5/02*** | (2006.01) |
| ***G09G 3/30*** | (2006.01) |
| ***G09G 3/32*** | (2006.01) |
| *G09G 3/20* | (2006.01) |

(52) U.S. Cl.

CPC ..... *G09G 3/30* (2013.01); *G09G 3/3291* (2013.01); *G09G 3/2025* (2013.01); *G09G 3/2081* (2013.01); *G09G 2300/0852* (2013.01); *G09G 2300/0861* (2013.01); *G09G 2310/027* (2013.01); *G09G 2320/0673* (2013.01); *G09G 2320/103* (2013.01)

(58) Field of Classification Search

None

See application file for complete search history.

(56) References Cited

U.S. PATENT DOCUMENTS

| | | | | |
|---|---|---|---|---|
| 6,753,854 | B1 * | 6/2004 | Koyama | G09G 3/3291 345/106 |
| 7,956,826 | B2 | 6/2011 | Childs et al. | |
| 2002/0076619 | A1 | 6/2002 | Yamada et al. | |
| 2003/0006952 | A1 * | 1/2003 | Hong | 345/89 |
| 2004/0080474 | A1 * | 4/2004 | Kimura | 345/82 |
| 2006/0109223 | A1 * | 5/2006 | Yang | 345/89 |
| 2006/0114198 | A1 | 6/2006 | Childs et al. | |
| 2007/0001977 | A1 * | 1/2007 | Shin | 345/98 |
| 2007/0200803 | A1 * | 8/2007 | Kimura | 345/76 |
| 2008/0129673 | A1 * | 6/2008 | Kim et al. | 345/89 |
| 2011/0279468 | A1 * | 11/2011 | Kiuchi et al. | 345/581 |

FOREIGN PATENT DOCUMENTS

| | | | |
|---|---|---|---|
| JP | 2002-134169 | A | 5/2002 |
| JP | 2005-534991 | A | 11/2005 |
| JP | 2009-169145 | A | 7/2009 |

* cited by examiner

*Primary Examiner* — Seokyun Moon

(74) *Attorney, Agent, or Firm* — McDermott Will & Emery LLP

(57) ABSTRACT

Provided is an EL display device that includes: an EL display panel including an array of a plurality of pixel circuits each having a drive transistor that applies a current to an organic EL element; a driver circuit that applies, to each of the pixel circuits, a signal in response to an image signal and a signal for selecting pixel circuits that are expected to emit light; and an N-bit D/A converter. An image display period in a single frame is divided into a first subframe and a second subframe, the first subframe performing display by light emission based on a gray-level signal of high N bits, the second subframe performing display by light emission based on a gray-level signal of low M bits (where M satisfies M<N), and light emission period L1 in the first subframe and light emission period L2 in the second subframe are controlled such that a relation therebetween satisfies L1>L2.

3 Claims, 7 Drawing Sheets

EL DISPLAY DEVICE

BACKGROUND OF THE INVENTION

1. Field of the Invention

The present invention relates to an active matrix EL display device using a current-driven light emitting element.

2. Description of the Related Art

Organic EL display devices using self light emitting organic electroluminescence (EL) elements do not require a backlight and have no limitation in their viewing angle, and therefore have been developed as a next-generation EL display device.

An organic EL element is a current-driven light emitting element that controls its luminance based on an amount of current flow. In recent years, active matrix organic EL display devices that include a drive transistor for each pixel circuit and drive an organic EL element have become the mainstream.

The drive transistor and its peripheral circuits are typically configured by thin-film transistors using polysilicon, amorphous silicon, or the like. Thin-film transistors are suitable for a large-sized organic EL display device, as it is easy to increase the size and the cost is low while having a weakness that variations in mobility and threshold voltages are large.

Further, designs of pixel circuits in order to overcome the variation and a chronological change in threshold voltages that are the weaknesses of thin-film transistors have been studied. For example, Unexamined Japanese Patent Publication No. 2009-169145 discloses an organic EL display device having a function of correcting a threshold voltage of a drive transistor and a method of driving this organic EL display device. Further, Unexamined Japanese Patent Publication No. 2002-134169 discloses an EL display device including a memory storing a gain and an offset of a luminance-voltage characteristic for each of pixels, and a correction circuit that corrects an image signal based on the data in the memory, wherein irregularity in luminance due to a luminance variation among pixels is reduced.

SUMMARY OF THE INVENTION

The technique disclosed herein relates to an EL display device provided with: an EL display panel including an array of pixel circuits each having a drive transistor operable to apply a current to an organic EL element; a driver circuit operable to apply, to each of the pixel circuits, a signal in response to an image signal and a signal for selecting pixel circuits that are expected to emit light; and an image signal processing circuit including an N-bit D/A converter and providing signal processing to an image signal that has been inputted, and supply the processed signal to the driver circuit. An image display period in a single frame is divided into at least two subframes including a first subframe and a second subframe, the first subframe performing display by light emission based on a gray-level signal of high N bits, the second subframe performing display by light emission based on a gray-level signal of low M bits (where M satisfies M<N), and the driver circuit is controlled such that a relation between light emission period L1 in the first subframe and light emission period L2 in the second subframe satisfies L1>L2.

DETAILED DESCRIPTION OF THE PREFERRED EMBODIMENT

Hereinafter, an EL display device according to one embodiment will be described with reference to the drawings. The EL display device described herein is an active matrix organic EL display device that uses drive transistors to cause organic EL elements to emit light. However, the present invention is applicable generally to an active matrix EL display device including: an array of a plurality of pixel circuits each having a current-driven light emitting element that controls its luminance based on an amount of current; and a drive transistor that applies a current to the current-driven light emitting element.

Figure 1:
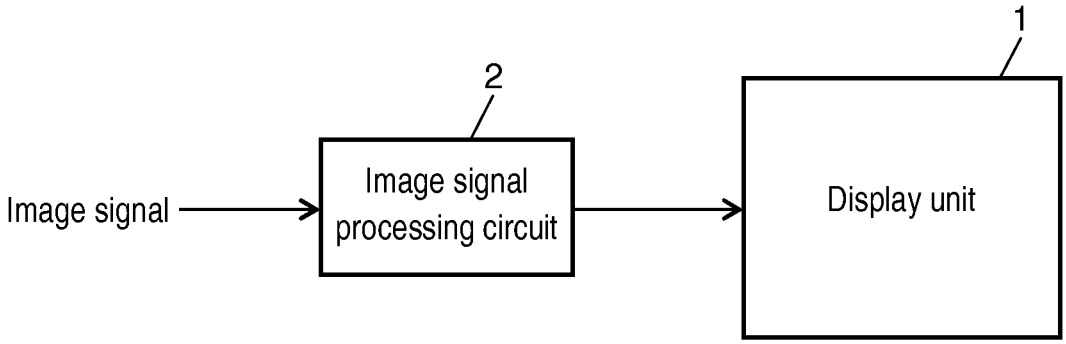
FIG. 1 is a configurational diagram illustrating an EL display device according to one embodiment.

FIG. 1 is a configurational diagram illustrating the EL display device according to one embodiment. The EL display device is provided with a display unit 1 including an EL display panel and a driver circuit, and image signal processing circuit 2 that performs signal processing to an image signal that has been inputted and supplies the processed signal to the driver circuit. The EL display panel includes an array of a plurality of pixel circuits each having a drive transistor that applies a current to an organic EL element as a current-driven light emitting element. The driver circuit applies, to each of the pixel circuits, a signal according to the image signal and a signal for selecting pixel circuits to be caused to emit light.

Figure 2:
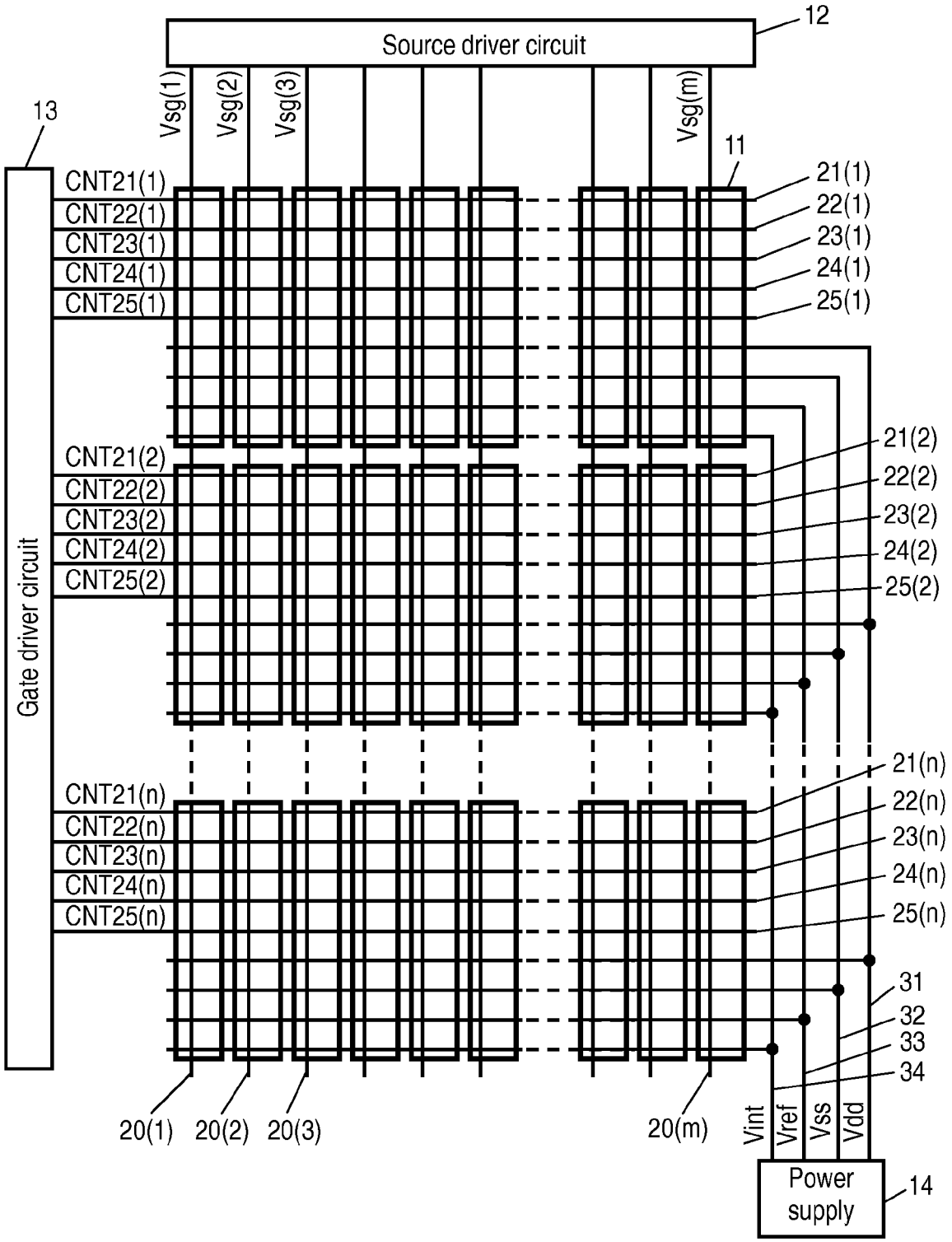
FIG. 2 is a configurational diagram illustrating a display unit of the EL display device.

FIG. 2 is a configurational diagram illustrating display unit 1 of the EL display device. Display unit 1 includes a number of pixel circuits 11(*i, j*) arranged in a matrix of n lines and m columns (where $1 \leq i \leq n$ and $1 \leq j \leq m$), source driver circuit 12, gate driver circuit 13, and power supply circuit 14.

Source driver circuit 12 supplies image signal voltages Vsg(j) respectively to data lines 20(*j*) to each of which pixel circuits 11(*i, j*) to 11(*n, j*) arranged in a column direction are connected in common. Further, gate driver circuit 13 supplies control signals CNT21(*i*) to CNT25(*i*) respectively to control signal line 21(*i*) to 25(*i*) to each of which pixel circuits 11(*i*, 1) to 11(*i, m*) arranged in a line direction are connected in common. In this embodiment, single pixel circuit 11(*i, j*) is supplied with five different control signals. However, the number of the control signals is not limited to this example, and it is possible to supply the control signals as many as needed.

Power supply circuit 14 supplies high voltage Vdd to power line 31 and low voltage Vss to power line 32, to both of which lines all of pixel circuits 11(1, 1) to 11(*n, m*) are connected in common. A power supply of high voltage Vdd and low voltage Vss is a power supply for causing organic EL elements that will be described later to emit light. Power supply circuit 14 also supplies reference voltage Vref to voltage line 33 and initialize voltage Vint to voltage line 34, to both of which lines all of pixel circuits 11(1, 1) to 11(*n, m*) are connected in common.

Figure 3:
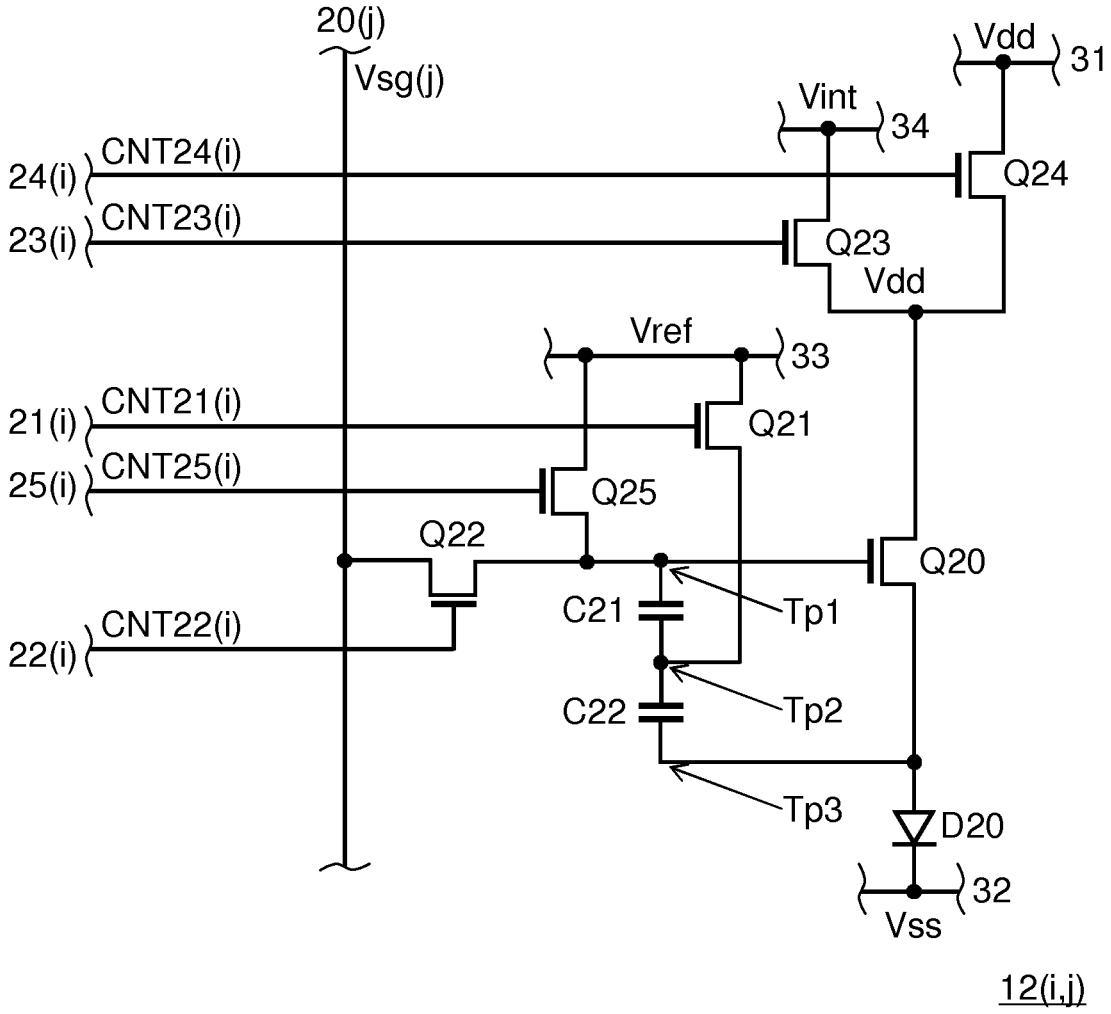
FIG. 3 is a circuit diagram illustrating one example of a pixel circuit of the display unit of the EL display device.

FIG. 3 is a circuit diagram illustrating one example of pixel circuit 11(*i, j*) of display unit 1. Pixel circuit 11(*i, j*) according to this embodiment includes organic EL element D20 that is a current-driven light emitting element, drive transistor Q20, first capacitor C21, second capacitor C22, and transistors Q21 to Q25 that operate as switches.

Drive transistor Q20 supplies a current to organic EL element D20. First capacitor C21 holds image signal voltage Vsg(j) corresponding to an image signal. Transistor Q21 is a switch for applying reference voltage Vref to one terminal of first capacitor C21 and one terminal of second capacitor C22. Transistor Q22 is a switch for writing image signal voltage Vsg(j) to first capacitor C21. Transistor Q25 is a switch for applying reference voltage Vref to a gate of drive transistor Q20. Second capacitor C22 holds threshold voltage Vth of drive transistor Q20. Transistor Q23 is a switch for applying initialize voltage Vint to a drain of drive transistor Q20, and transistor Q24 is a switch for applying high voltage Vdd to the drain of drive transistor Q20.

In the following description, all of drive transistor Q20 and transistors Q21 to Q25 are described as N-channel thin-film transistors of an enhancement-type. However, the present invention is not limited to such an example.

In pixel circuit 11(*i, j*) according to this embodiment, transistor Q24, drive transistor Q20, and organic EL element D20 are connected in series between power line 31 and power line 32. Specifically, a drain of transistor Q24 is connected to power line 31, a source of transistor Q24 is connected to the drain of drive transistor Q20, a source of drive transistor Q20 is connected to an anode of organic EL element D20, and a cathode of organic EL element D20 is connected to power line 32.

Between the gate and the source of drive transistor Q20, first capacitor C21 and second capacitor C22 are connected in series. Specifically, one terminal of first capacitor C21 is connected to the gate of drive transistor Q20, and second capacitor C22 is connected between the other terminal of first capacitor C21 and the source of drive transistor Q20. A node connecting the gate of drive transistor Q20 and first capacitor C21 is referred to as "node Tp1", a node connecting first capacitor C21 and second capacitor C22 is referred to as "node Tp2", and a node connecting second capacitor C22 and the source of drive transistor Q20 is referred to as "node Tp3".

A drain (or source) of transistor Q21 as a first switch is connected to voltage line 33 to which reference voltage Vref is supplied, the source (or drain) of transistor Q21 is connected to node Tp2, and a gate of transistor Q21 is connected to control signal line 21(*i*). By being connected in this manner, transistor Q21 applies reference voltage Vref to node Tp2.

A drain (or source) of transistor Q22 as a second switch is connected to node Tp1, the source (or drain) of transistor Q22 is connected to data line 20(*j*) to which image signal voltage Vsg is supplied, and a gate of transistor Q22 is connected to control signal line 22(*i*). By being connected in this manner, transistor Q22 applies image signal voltage Vsg to the gate of drive transistor Q20.

A drain (or source) of transistor Q25 as a fifth switch is connected to voltage line 33 to which reference voltage Vref is supplied, the source (or drain) of transistor Q25 is connected to node Tp1, and a gate of transistor Q25 is connected to control signal line 25(*i*). By being connected in this manner, transistor Q25 applies reference voltage Vref to the gate of drive transistor Q20.

A drain (or source) of transistor Q23 as a third switch is connected to the drain of drive transistor Q20, the source (or drain) of transistor Q23 is connected to voltage line 34 to which initialize voltage Vint is supplied, and a gate of transistor Q23 is connected to control signal line 23(*i*). By being connected in this manner, transistor Q23 applies initialize voltage Vint to the drain of drive transistor Q20.

The drain of transistor Q24 as a fourth switch is connected to power line 31, the source of transistor Q24 is connected to the drain of drive transistor Q20, and a gate of transistor Q24 is connected to control signal line 24(*i*). By being connected in this manner, transistor Q24 applies a current for causing organic EL element D20 to emit light to the drain of drive transistor Q20. Here, control signal lines 21(*i*) to 25(*i*) are supplied with control signals CNT21(*i*) to CNT25(*i*), respectively.

As described above, pixel circuit 11(*i, j*) includes: first capacitor C21 having one terminal connected to the gate of drive transistor Q20, second capacitor C22 connected between the other terminal of first capacitor C21 and the source of drive transistor Q20, transistor Q21 as the first switch that applies reference voltage Vref to node Tp2 between first capacitor C21 and second capacitor C22, transistor Q22 as the second switch that supplies image signal voltage Vsg to the gate of drive transistor Q20, transistor Q25 as the fifth switch that applies reference voltage Vref to the gate of drive transistor Q20, transistor Q23 as the third switch that supplies initialize voltage Vint to the drain of drive transistor Q20, and transistor Q24 as the fourth switch that supplies the current for causing organic EL element D20 to emit light to the drain of drive transistor Q20.

Figure 4:
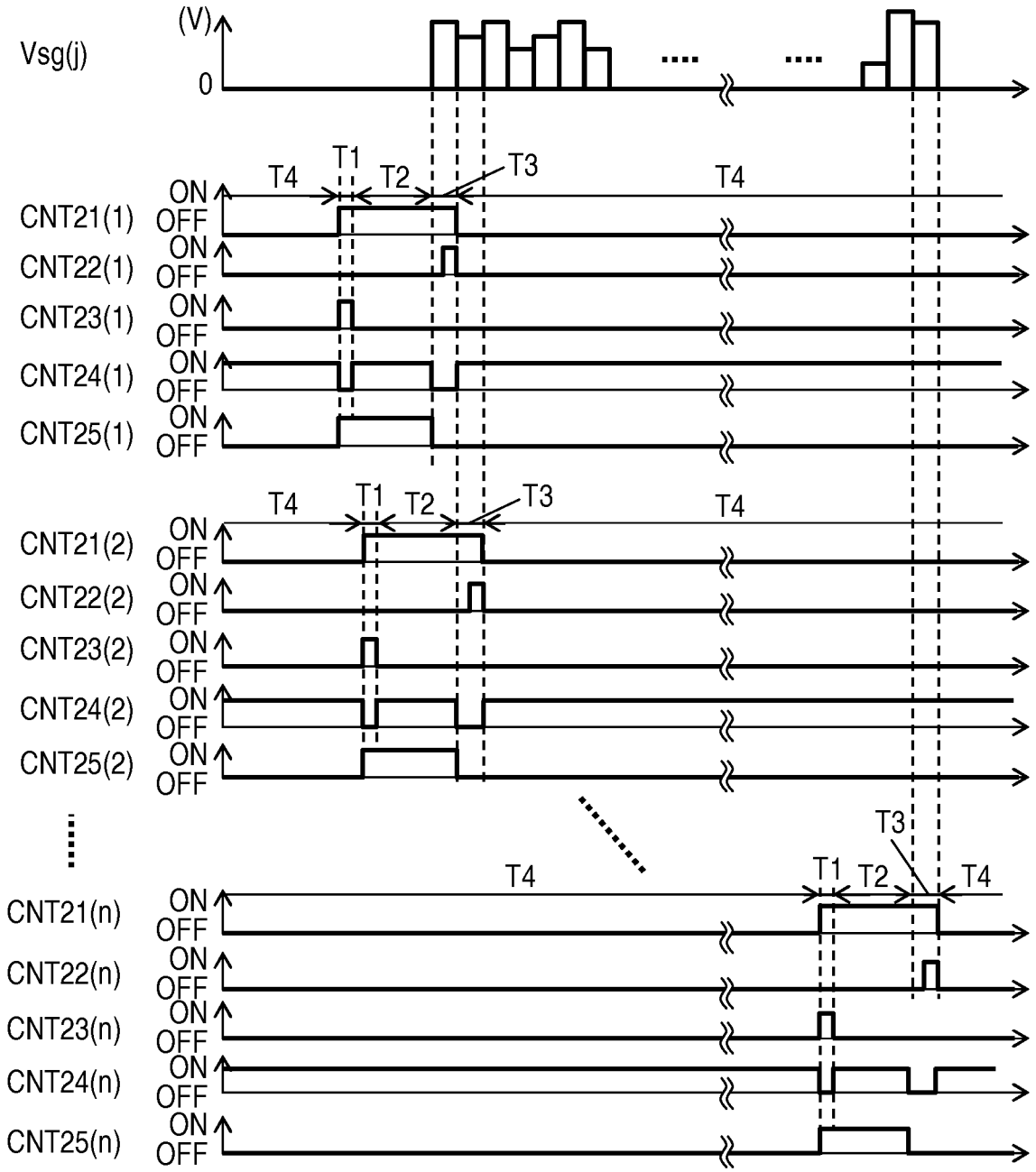
FIG. 4 is a timing chart showing an operation of the display unit of the EL display device.

Next, an operation of pixel circuit 11(*i, j*) is described. FIG. 4 is a timing chart showing an operation of display unit 1 of the EL display device. Organic EL element D20 of pixel circuit 11(*i, j*) is driven by dividing a single frame period into initialization period T1, threshold detection period T2, write period T3, and light emission period T4, as shown in the figure.

In initialization period T1, second capacitor C22 is charged to a predetermined voltage. In threshold detection period T2, threshold voltage Vth of drive transistor Q20 is detected. In write period T3, image signal voltage Vsg(j) corresponding to an image signal is written to first capacitor C21. Then, in light emission period T4, a voltage as a sum of inter-terminal voltages between the terminals of first capacitor C21 and of second capacitor C22 is applied between the gate and the source of drive transistor Q20, and whereby a current corresponding to the image signal is supplied to organic EL element D20 and organic EL element D20 is caused to emit light at luminance corresponding to a value of the supplied current.

These four periods are set so as to be common to m pixel circuits 11(*i*, 1) to 11(*i, m*) in a single line that are arranged in a line direction as illustrated in FIG. 2, and such that write period T3 for one line of pixels does not overlap with a different line of pixels. In this manner, it is possible to use driving time efficiently by performing operations such that, during a period in which the writing operation is performed for one line of pixels, the operations other than writing for different lines of pixels are performed.

Figure 5:
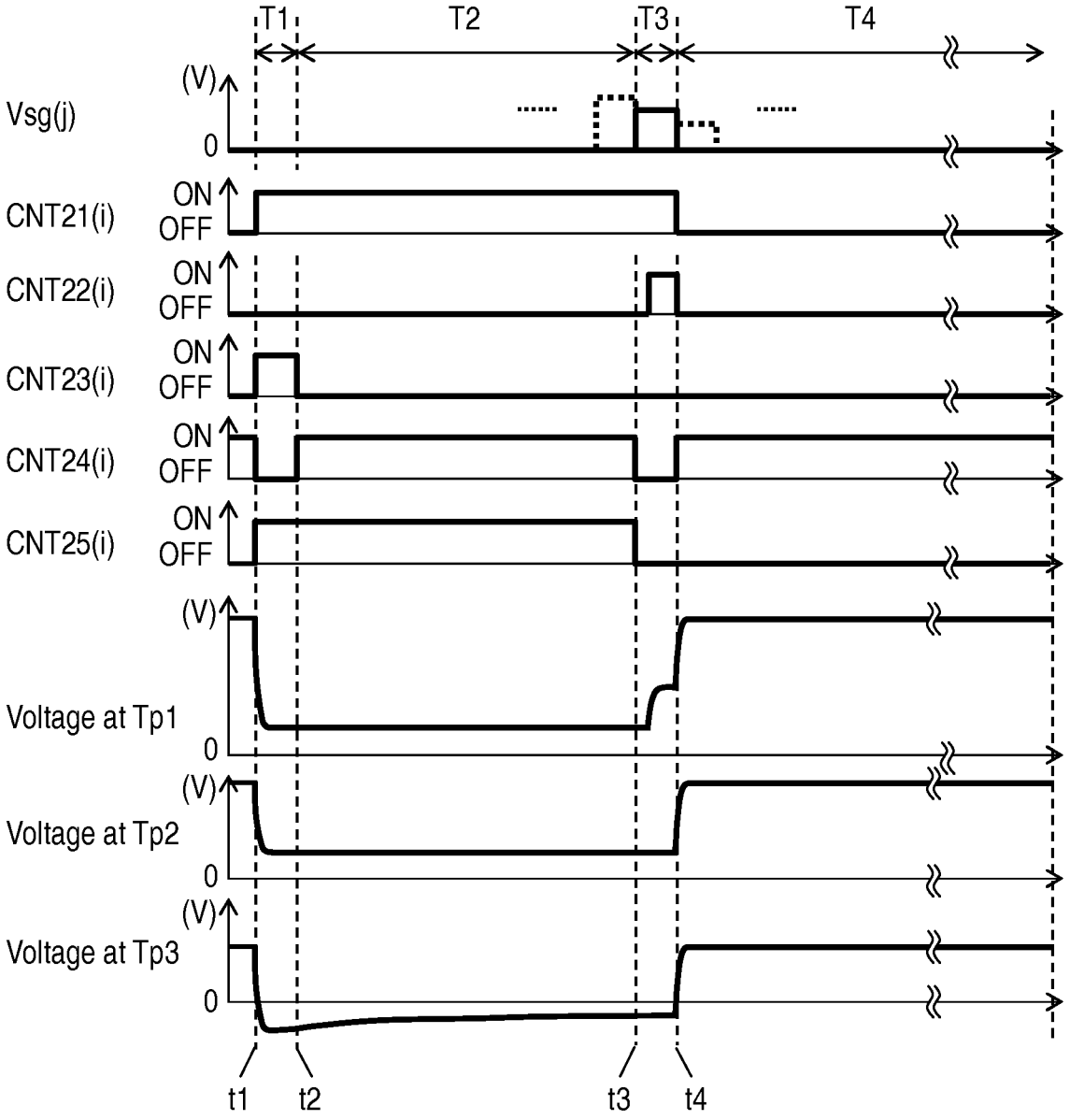
FIG. 5 is a timing chart showing an operation of the pixel circuit of the display unit of the EL display device.

FIG. 5 is a timing chart showing the operation of pixel circuit 11(*i, j*) of display unit 1 of the EL display device. FIG. 5 also shows changes in voltages at nodes Tp1 to Tp3. Hereinafter, the operation of pixel circuit 11(*i, j*) in the periods listed above will be described in detail.

Initialization Period T1

At time t1, control signals CNT22(*i*) and CNT24(*i*) are driven to low level to turn transistors Q22 and Q24 to an OFF state, and control signals CNT21(*i*), CNT23(*i*), and CNT25(*i*) are driven to high level to turn transistor Q21, Q23, Q25 to an ON state. Then, reference voltage Vref is applied to node Tp1 via transistor Q25, as well as to node Tp2 via transistor Q21.

Further, initialize voltage Vint is applied to the drain of drive transistor Q20 via transistor Q23. Here, initialize voltage Vint is set to be sufficiently lower than a voltage obtained by subtracting threshold voltage Vth from reference voltage Vref. Specifically, the following relation is established: Vint<Vref−Vth. Consequently, a source voltage of drive transistor Q20, that is, the voltage at node Tp3 is also nearly equal to initialize voltage Vint. With this, a voltage higher than threshold voltage Vth (Vref-Vint) is charged between the terminals of second capacitor C22.

Moreover, initialize voltage Vint is set to be a voltage lower than a sum of low voltage Vss and voltage Vled, as obtained from condition 1 and condition 2. Specifically, the following relation is established: Vint<Vss+Vled. As a result, a current is not supplied to organic EL element D20, and organic EL element D20 may not emit light. In this embodiment, initialization period T1 is set to be 1 μs.

Threshold Detection Period T2

At time t2, control signal CNT23(*i*) is driven to low level to turn transistor Q23 to the OFF state, and control signal CNT24(*i*) is driven to high level to turn transistor Q24 to the ON state. Then, as the inter-terminal voltage (Vref-Vint) of second capacitor C22 that is higher than threshold voltage Vth is applied between the gate and the source of drive transistor Q20, a current is supplied to drive transistor Q20. However, as a voltage at the anode of organic EL element D20 is far lower than the voltage obtained by subtracting threshold voltage Vth from reference voltage Vref such that the relation of Vref−Vth<Vss+Vled is established, a current is not supplied to organic EL element D20. Then, due to the current supplied to drive transistor Q20, the electric charge in second capacitor C22 is discharged, and the inter-terminal voltage of second capacitor C22 starts to decrease. However, the inter-terminal voltage of second capacitor C22 is still higher than threshold voltage Vth, and therefore the current continues to be supplied, while decreasing, to drive transistor Q20. Consequently, the inter-terminal voltage of second capacitor C22 continues to decrease gradually. In this manner, the inter-terminal voltage of second capacitor C22 becomes gradually closer to threshold voltage Vth. Then, at time when the inter-terminal voltage of second capacitor C22 becomes equal to threshold voltage Vth, the supply of the current to drive transistor Q20 stops, and the decrease of the inter-terminal voltage of second capacitor C22 also stops. As described above, second capacitor C22 is a correcting capacitor that corrects threshold voltage Vth of corresponding drive transistor Q20.

Write Period T3

At time t3, control signal CNT25(*i*) is driven to low level to turn transistor Q25 to the OFF state, and control signal CNT24(*i*) is driven to low level to turn transistor Q24 to the OFF state. Thereafter, control signal CNT22(*i*) is driven to high level to turn transistor Q22 to the ON state. Then, the voltage at node Tp1 becomes analog image signal voltage Vsg(j), and voltage (Vsg−Vref) is charged between the terminals of first capacitor C21. Voltage (Vsg−Vref) is taken as image signal voltage Vsg'. At this time, as a current is not supplied to drive transistor Q20, the inter-terminal voltage of second capacitor C22 does not change. In this embodiment, write period T3 is set to be 1 msec.

Light Emission Period T4

At time t4, control signal CNT22(*i*) is driven to low level to turn transistor Q22 to the OFF state, and control signal CNT21(*i*) is driven to low level to turn transistor Q21 to the OFF state. With this, nodes Tp1 to Tp3 are temporarily brought into a floating state. Then, control signal CNT24(*i*) is driven to high level to turn transistor Q24 to the ON state. With this, the source voltage increases as analog voltage (Vsg'+Vth) is applied between the gate and the source of drive transistor Q20, and a current corresponding to the gate-source voltage of drive transistor Q20 is supplied to organic EL element D20. Current I at this time is expressed by I=K·(VGS−Vth)=K·Vsg' (where VGS is the gate-source voltage, and K is a constant), and the current corresponding to the image signal is supplied to organic EL element D20. Then, organic EL element D20 emits light based on the current corresponding to the analog image signal voltage supplied from source driver circuit 12 through the data line. The luminance at this time corresponds to the current supplied to organic EL element D20.

Organic EL element D20 emits light at luminance corresponding to the analog image signal voltage inputted from source driver circuit 12 through the steps as described above, and it is possible to realize color display by controlling the luminance for each of RGB. Further, it is possible to realize image display at predetermined gray levels by controlling the current supplied to organic EL element D20 to change the luminance.

As described above, in the EL display device, a current supplied to an organic EL element is controlled according to a voltage based on an image signal, and whereby it is possible to cause light emission at predetermined luminance.

In the meantime, in order to realize high quality image display in the EL display device at various gray levels from low gray levels to high gray levels based on high resolution image signals, it is necessary to perform digital-analog conversion using a D/A converter corresponding to the bit number of digital image signals that are inputted, and to supply analog voltages corresponding to the inputted image signals to the respective pixel circuits. However, there is a problem that when using a D/A converter that is able to process a signal of a higher bit number, costs for an electric circuit increases.

Thus, according to this embodiment, an EL display device is provided with: an EL display panel including an array of a plurality of pixel circuits each having a drive transistor that applies a current to an organic EL element; a driver circuit that applies, to each of the pixel circuits, a signal according to an image signal and a signal for selecting pixel circuits to be caused to emit light; and an image signal processing circuit including an N-bit D/A converter and that performs signal processing to an image signal that has been inputted and supply the processed signal to the driver circuit, and an image display period in a single frame is divided into a first subframe and a second subframe, the first subframe being for performing display by light emission based on a gray-level signal of high N bits, the second subframe being for performing display by light emission based on a gray-level signal of low M bits (where M satisfies M<N), and the driver circuit is controlled such that a relation between light emission period L1 in the first subframe and light emission period L2 in the second subframe satisfies L1>L2, and whereby it is possible to perform gray-level display of a data amount of N+M bits using the N-bit D/A converter.

Hereinafter, a configuration and an operation of image signal processing circuit 2 of the EL display device are described with reference to FIG. 6, FIGS. 7A and 7B.

Figure 6:
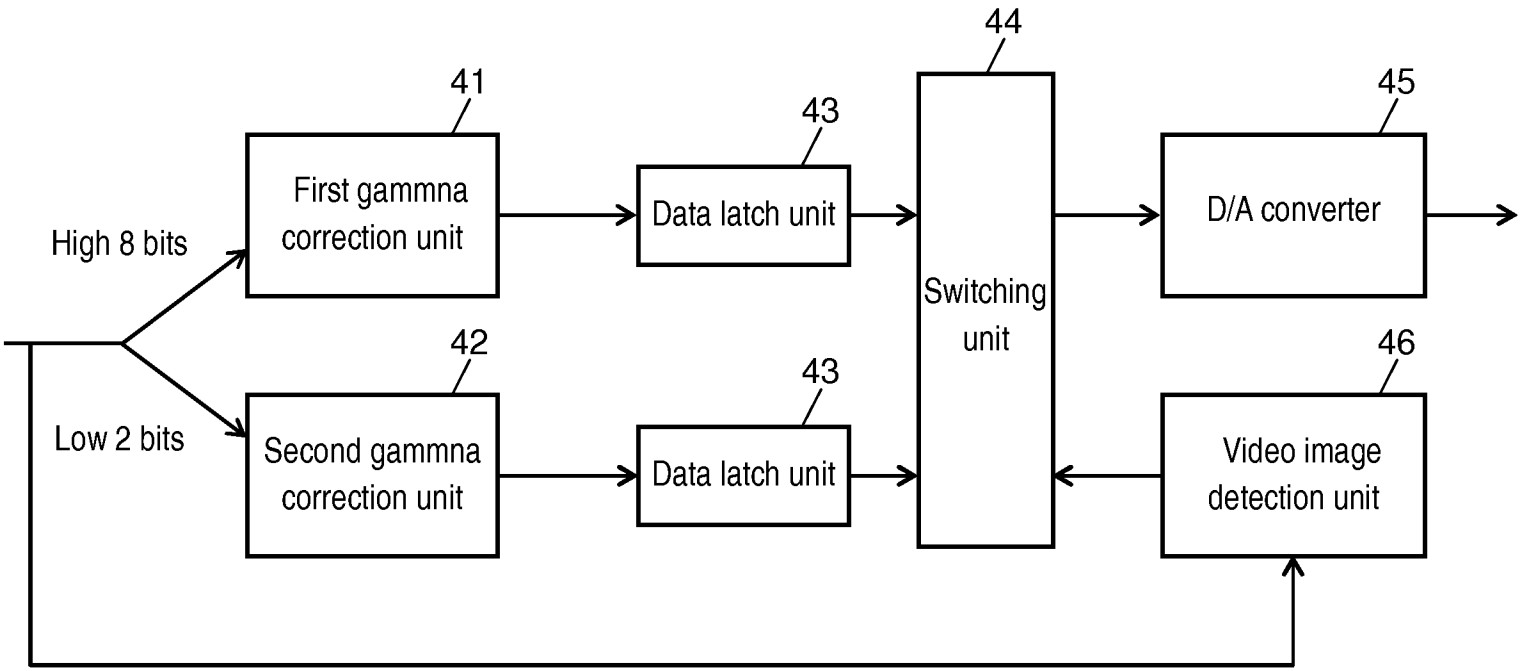
FIG. 6 is a circuit block diagram of an image signal processing circuit of the EL display device.

FIG. 6 is a block circuit diagram showing one example of an image signal processing circuit provided with an 8-bit D/A converter as the N-bit D/A converter.

Referring to FIG. 6, a signal of high 8 bits in a 10-bit digital image signal that has been inputted is inputted to first gammna correction unit 41, and a signal of low 2 bits in the inputted signal is inputted to second gammna correction unit 42. The signal of the high 8 bits and the signal of the low 2 bits that have been inputted respectively to first gammna correction unit 41 and second gammna correction unit 42 are corrected so as to have predetermined gamma characteristics, and then inputted to data latch unit 43, which then holds the data. Here, each of the first gammna correction unit 41 and second gammna correction unit 42 is for correcting a signal so as to provide the signal with a gamma characteristic that has been previously set for an inputted image signal, and outputting the corrected signal.

The data held by data latch unit 43 is inputted to 8-bit D/A converter 45 by being sequentially switched by switching unit 44 in synchronization with a synchronization signal of the image signal, and subjected to digital-analog conversion and supplied to the source driver circuit of EL display unit 1. Specifically, by employing such a configuration, an image display period for a single frame is divided into two subframes: a first subframe for performing display by light emission based on a gray-level signal of the high 8 bits, and a second subframe for performing display by light emission based on a gray-level signal of the low 2 bits, and an image for a single frame is displayed based on the first subframe for performing display by light emission based on the gray-level signal of the high 8 bits and the second subframe for performing display by light emission based on the gray-level signal of the low 2 bits.

In FIG. 6, reference numeral 46 represents a video image detection unit that performs motion detection for detecting whether an image is a video image or a still image based on an image signal that has been inputted. If it has been detected that the inputted image signal is an image signal for a video image, switching unit 44 is controlled such that display by light emission is performed based only on the high 8 bits of the image signal in a first subframe period, and that light emission is not performed for the low 2 bits of the image signal in a second subframe period, and whereby it is possible to prevent occurrence of false contours in the video image. In addition, it is possible to improve resolution of the video image, as black-mode display is performed in the second subframe.

Figure 7A:
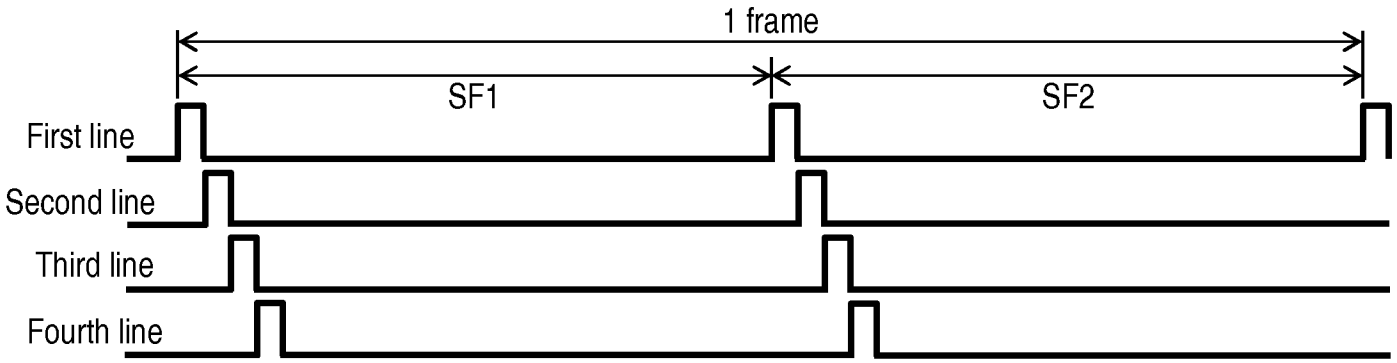
FIG. 7A is a timing chart for the write period for illustration of a light-emitting operation of the EL display device.
Figure 7B:
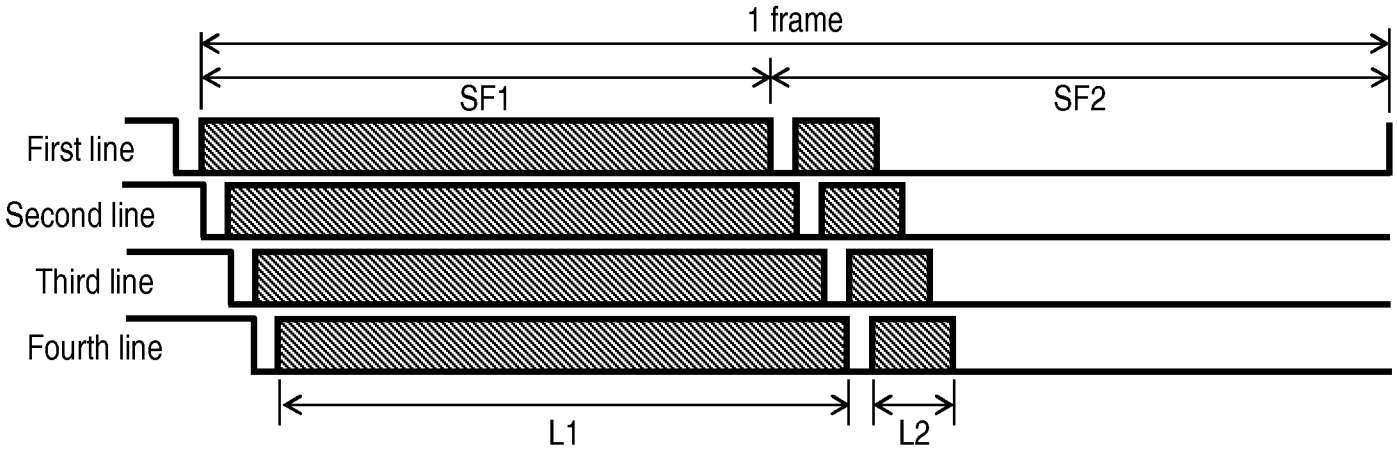
FIG. 7B is a timing chart for the light emission period for illustration of a light-emitting operation of the EL display device.

Further, FIGS. 7A and 7B illustrate examples of driving when the image display period in a single frame is divided into first subframe SF1 and second subframe SF2. FIG. 7A is a timing chart for the write period, and FIG. 7B is a timing chart for the light emission period. Referring to FIG. 7B, portions represented by slant lines correspond to light emission periods in the first subframe and the second subframe.

As illustrated in FIGS. 7A and 7B, in first subframe SF1 and second subframe SF2 that constitute a single frame, write voltages are sequentially applied along a line direction to perform the writing during the write period as described with reference to FIG. 4 and FIG. 5. In the subsequent light emission period, either timing for switching or the power supply in the pixel circuit of the driver circuit is controlled such that a relation between light emission period L2 in the second subframe and light emission period L1 in the first subframe is L1>L2, as shown by the slant lines in FIG. 7B. During light emission period L2 in the second subframe, by setting light emission period L2 to be about 1/50 of light emission period L1 in the first subframe, and by increasing a current supplied instantaneously in the second subframe, it is possible to drive to emit light in a state in which a dynamic range of the driver circuit remains the same both in the first subframe and in the second subframe.

As described above, first gammna correction unit 41 that receives an image signal of the high 8 bits for the first subframe, second gammna correction unit 42 that receives an image signal of the low 2 bits for the second subframe, and switching unit 44 that switches between first gammna correction unit 41 and second gammna correction unit 42, and to output a signal outputted from the switched correction unit to 8-bit D/A converter 45 are provided, and it is possible to perform display based on image signals (gray-level signals) of 10-bit resolution with the configuration using 8-bit D/A converter 45.

Further, light emission period L1 in the first subframe and light emission period L2 in the second subframe are controlled such that their relation is L1>L2, and it is possible to realize driving with reduced output deviation of the driver circuit.

In the embodiment described above, there is shown an example in which display by light emission is performed using the 8-bit D/A converter by dividing a single frame into the first subframe in which display by light emission is performed based on the gray-level signal of the high 8 bits and the second subframe in which display by light emission is performed based on the gray-level signal of the low 2 bits. However, the bit number may be determined appropriately, and it is possible to perform display by light emission using an N-bit D/A converter by dividing a single frame into at least a first subframe in which display by light emission is performed based on a gray-level signal of the high N bits and a second subframe in which display by light emission is performed based on a gray-level signal of the low M bits (where M satisfies M<N).

As described above, the EL display device is provided with an image signal processing circuit including an N-bit D/A converter and that performs signal processing to an image signal that has been inputted and supply the processed signal to the driver circuit of the display unit, and an image display period in a single frame is divided into at least a first subframe and a second subframe, the first subframe being for performing display by light emission based on a gray-level signal of high N bits, the second subframe being for performing display by light emission based on a gray-level signal of low M bits (where M satisfies M<N), and the driver circuit is controlled such that a relation between light emission period L1 in the first subframe and light emission period L2 in the second subframe satisfies L1>L2, and whereby it is possible to perform gray-level display of a data amount of N+M bits using the N-bit D/A converter.

What is claimed is:

1. An electroluminescence (EL) display device, comprising:

an EL display panel including an array of a plurality of pixel circuits each having a drive transistor configured to apply a current to an organic EL element;

a driver circuit configured to apply, to each of the pixel circuits, a signal in response to an image signal and a signal for selecting pixel circuits that are expected to emit light; and an image signal processing circuit including an N-bit D/A converter and providing signal processing to an (N+M)-bit digital image signal that has been inputted, and supply a processed analog signal to the driver circuit, where N and M are positive integers and M is smaller than N, wherein:

an image display period in a single frame is divided into at least two subframes including a first subframe and a second subframe, in the first subframe, displaying by light emission is performed based on an analog gray-level signal of upper N bits of the digital image signal, and in the second subframe, displaying by light emission is performed based on an analog gray-level signal of lower M bits of the digital image signal, and the driver circuit is controlled such that a relation between light emission period L1 in the first subframe and light emission period L2 in the second subframe satisfies L1>L2.

2. The EL display device according to claim 1, wherein the image signal processing circuit includes:

a first gamma correction unit configured to receive the upper N bits of the digital image signal for the first subframe in the digital image signal that has been inputted;

a second gamma correction unit configured to receive the lower M bits of the digital image signal for the second subframe in the digital image signal that has been inputted; and a switching unit configured to switch between the first gamma correction unit and the second gamma correction unit, and to output a signal outputted from the switched correction unit to the N-bit D/A converter.

3. The EL display device according to claim 1, wherein the image signal processing circuit includes a video image detection unit to detect whether or not the digital image signal that has been inputted is for a motion video image, and when the video image detection unit has detected that the digital image signal that has been inputted is for a motion video image, a light emission is prevented during a period of the second subframe.

* * * * *